United States Patent [19]

Feichtinger

[11] 4,411,227

[45] Oct. 25, 1983

[54] INTERNAL COMBUSTION ENGINE

[75] Inventor: Gerhard Feichtinger, Graz, Austria

[73] Assignee: Hans List, Graz, Austria

[21] Appl. No.: 321,047

[22] Filed: Nov. 13, 1981

[30] Foreign Application Priority Data

Nov. 27, 1980 [AT] Austria ..... 5811/80

[51] Int. Cl.[3] ..... F01M 1/00

[52] U.S. Cl. ..... 123/196 R; 123/198 C; 123/195 R; 418/170

[58] Field of Search ..... 123/196 R, 198 C, 195 R, 123/195 A, 195 S; 418/170

[56] References Cited

U.S. PATENT DOCUMENTS

| | | | |
|---|---|---|---|
| 2,847,986 | 8/1958 | Haas | 123/195 A |
| 3,616,786 | 11/1971 | Hatz | 123/195 A |
| 3,857,378 | 12/1974 | Nakamura | 123/196 R |
| 3,926,157 | 12/1975 | Lippitsch | 123/198 C |
| 4,114,586 | 9/1978 | Fujikawa et al. | 123/195 A |
| 4,213,439 | 7/1980 | Feichtinger et al. | 123/195 S |
| 4,295,807 | 10/1981 | Krüger | 123/196 R |
| 4,313,405 | 2/1982 | Skatsche et al. | 123/195 S |
| 4,334,508 | 6/1982 | Susaki | 123/195 A |

*Primary Examiner*—Charles J. Myhre
*Assistant Examiner*—E. Rollins Cross
*Attorney, Agent, or Firm*—Watson, Cole, Grindle & Watson

[57] ABSTRACT

The oil pump of an internal combustion engine having an engine unit support elastically suspended in a crankcase, is arranged in a front wall of the crankcase and actuated by a flexible shaft driven by the crankshaft of the engine. Thereby, a vibrational decoupling between the engine unit support and the crankcase is ensured and a ducting of the pressurized oil out of the crankcase is simplified.

2 Claims, 2 Drawing Figures

INTERNAL COMBUSTION ENGINE

BACKGROUND OF THE INVENTION

The invention relates to an internal combustion engine comprising an engine unit support elastically suspended in a crankcase and an oil pump driven by the crankshaft of the engine.

DESCRIPTION OF THE PRIOR ART

An internal combustion engine of the type referred to above is known from U.S. Pat. No. 4,213,439, wherein the oil pump, directly driven over spur gears from the crankshaft, is arranged within the upward extended crankcase on the engine unit support, so that the oil pump follows the elastic motion of the engine unit support relative to the crankcase. This will enable driving the oil pump in a simple manner, which must be ensured in operation of the internal combustion engine, but difficulties will arise since the oil pump follows the motions of the engine unit support relative to the crankcase so that ducting the line for the pressurized oil out of the crankcase—for example in high-performance engines where the oil, subjected to considerable heating-up in operation must be recooled in an externally located oil cooler—will require a very expensive design, or will prove altogether impossible because of the very limited space available in the compact engines of today.

SUMMARY OF THE INVENTION

It is an object of the present invention, to improve upon an internal combustion engine of the aforementioned type in such a manner, that the noted disadvantages of the known designs will be avoided and that the ducting of the pressurized oil out of the crankcase is simplified in its design, while a secure drive for the oil pump is nevertheless maintained.

According to the present invention, this will be attained by arranging the oil pump in a front wall of the crankcase and by actuating the pump by a flexible shaft driven by the crankshaft of the engine. Arranging the oil pump in a front wall of the crankcase, as known per se from internal combustion engines with crankshafts rigidly supported in the crankcase, will, in a simple manner, obviate the difficulties in ducting the pressurized oil out of the crankcase. The difficulties arising in respect of driving the oil pump rigidly supported in the crankcase wall by means of a crankshaft elastically supported relative to the crankcase are avoided of in a very simple and advantageous manner by the arrangement of the flexible shaft as an elastic intermediate member between the driving crankshaft and the driven oil pump. The decoupling of both components in respect of solid-borne-noise, obtained by the elastic suspension of the engine unit support in the crankcase, will not be affected by the flexible shaft, as it is elastic in respect of vibration and will thus substantially transmit only the rotary motion required for driving the oil pump.

According to a particularly preferred embodiment of the invention, provision is made for the flexible shaft to be inserted at its end facing the oil pump into a bearing bushing of hollow cylindrical shape supporting the driven oil pump gear and to be rotatively connected at that end to the end of the bearing bushing, with the other end of the flexible shaft to be inserted into a rotating sleeve of hollow cylindrical shape which is rotatively supported at least in the first two lower bearing brackets of the engine crankshaft main bearings adjacent the oil pump, with the rotating sleeve being driven at its end facing the oil pump by the crankshaft of the internal combustion engine and being rotatably connected at its other end to the flexible shaft, with at least one end of the flexible shaft being axially displaceable within its rotative connection. By such construction of the supporting arrangement and also of input and output drive of the flexible shaft, optimal utilization is attained in a particularly advantageous manner of the very limited internal crankcase space as available in modern internal combustion engines. It is also practicable in a very simple manner to obtain a greater free flexing length of the flexible shaft, for instance by extending the rotating sleeve supported in the lower bearing brackets up to the third crankshaft main bearing, if necessary in order to avoid impeding the free elastic oscillation of the engine unit support relative to the crankcase. The flexible shaft is arranged—except for the rotatively connected end facing away from the driven oil pump—with an annular gap toward the rotating sleeve which is disposed at least approximately coaxial to the flexible shaft. The annular gap is of such size that the relative motions between the two aforementioned components will not be impeded by the flexible shaft striking against the rotating sleeve. By allowing axial displacement relative to the rotative connection in the rotating sleeve, of at least one end of the flexible shaft, it also becomes practicable to provide for compensating the axial motion of the engine unit support. This axial motion is usually already prevented to a high degree by the design of the elastic suspension of the engine unit support in the crankcase.

According to a further proposal of the invention, the side of the rotating sleeve facing the oil pump is rotatively connected to a drive gear which is in mesh with a corresponding gear on the crankshaft. Drive of the oil pump which, while giving consideration to safety requirements, could also be effected by a chain, toothed chain or the like, is thus constructed in a simple manner and may readily be located in the free space available within the interior of the crankcase.

DESCRIPTION OF THE DRAWINGS

The present invention is described in detail below with reference to the embodiment depicted in the accompanying drawing, wherein.

DESCRIPTION OF A PREFERRED EMBODIMENT

Figure 1:
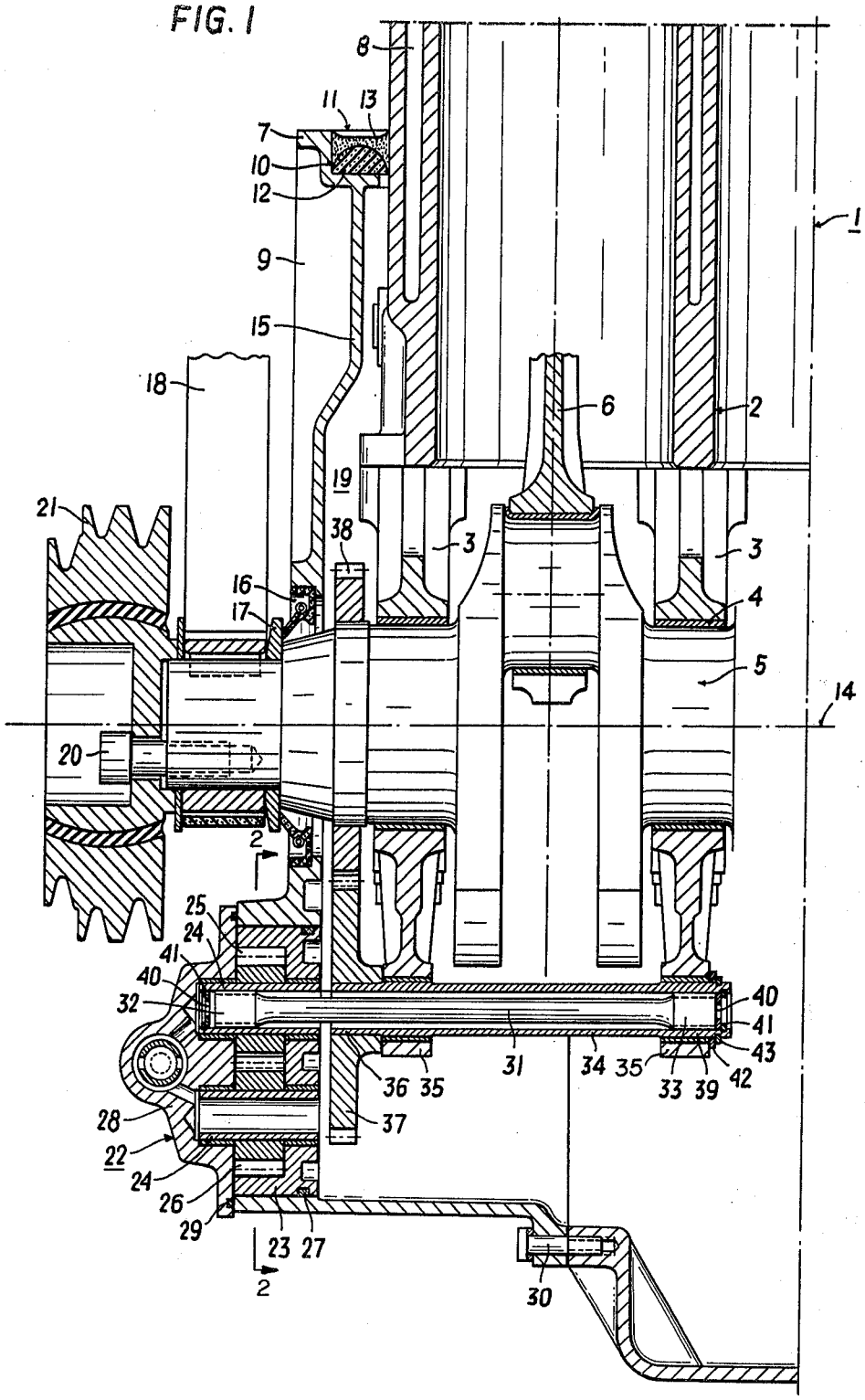
FIG. 1 is a partial longitudinal sectional view taken through an internal combustion engine constructed according to the invention and FIG. 2 is a partial sectional view taken along the line 2—2 of FIG. 1.

The engine unit support 1 of a water-cooled internal combustion engine comprises, in addition to the cylinder block 2 formed integrally with the cylinder head, the bearing walls 3, fixed (in a manner not shown herein) to the lower cylinder ends and serving to support the crankshaft main bearings 4 with the crankshaft 5, connecting rods 6 and the pistons (not shown). At the upper rim 7 of crankcase 9, which is extended upwardly to about the middle of a cylinder water jacket 8, there is provided an elastic sealing element 11, located within a circular groove 10, which sealing element is formed by a backing element 12 located within groove 10 and by sealing material 13 which will be cast-in during assembly after insertion of the backing element. The engine unit support 1, which is elastically supported (in a manner not shown herein) within crankcase 9, for example by elastic elements arranged approximately at the height of the crankshaft axis 14 in the zone of the bearing walls 3, will thus be sealed relative to the upward extended rim 7 of the crankcase and any escaping of oil from the internal space of the crankcase 9 is thereby prevented.

While the elastic support of the engine unit support and also the elastic sealing element 11 will, on one hand, in a very advantageous manner prevent the transmission of solid-borne-noise from the engine unit support onto the crankcase with its very large sound-radiating areas, it is, however, this elastic suspension which will permit relative movements between the engine unit support and the crankcase during operation of the internal combustion engine and appropriate allowance must be made for such motions. It is for this reason that the projection of crankshaft 5 from front wall 15 of the crankcase 9 be provided with an elastic seal ring 16 abutting a deflector flange 17 for the toothed belt 18 which, in turn drives an overhead camshaft (not shown). The seal ring 16 seals the internal space 9 of crankcase 19 against the emission of oil and noise. A V-belt pulley 21 is fixed by screws 20 to the terminal end of crankshaft 5 and serves to drive ancillary equipment (not shown) of the internal combustion engine.

An oil pump 22 is arranged in the front wall 15 below the passage of crankshaft 5 through crankcase 9, and serves to supply the internal combustion engine with pressurized oil for lubrication and cooling. As can be seen in particular also from FIG. 2, the oil pump 22 is provided in the embodiment shown with a pump body 23 of substantially cylindrical external contour. The pump body accommodates one end of cylindrical bearing bushings 24, which serve to support oil pump gears 25, 26, and is inserted into an appropriate bore of front wall 15 of the crankcase, with an oil seal 27 interposed between the front wall and the pump body. The pump body 23 is covered at its outer end by a pump cover 28 which will accommodate the outer ends of bearing bushes 24 and is fixed, with an oil seal 29 interposed, to the crankcase. The pump body is also provided with a regulating valve. To simplify machining and assembly of the crankcase, it comprises a two-part construction and is fastened at the zone of the first cylinder by screws 30.

In order to allow the drive of the oil pump 22 supported in front wall 15 to be effected from crankshaft 5, despite the relative motion between engine unit support 1 and crankshaft 9 when the internal combustion engine is in operation, provision is made for a flexible shaft 31 which at its end 32 facing oil pump 22 is inserted into the hollow cylindrical bushing 24 supporting the driven pump gear 25, and which is rotatively connected to that end of the bushing facing away from the internal space of crankcase 9. The other end 33 of the flexible shaft 31 is inserted into a hollow cylindrical rotating sleeve 34 which is rotatively supported in the first two bearing brackets 35 of the crankshaft main bearings 4 adjacent oil pump 22. The rotating sleeve 34 is driven at its end 36 facing the oil pump 22 by a drive gear 37, which is driven in turn by a corresponding gear wheel 38 on crankshaft 5. The other end 39 of rotating sleeve 34 is rotatively connected to the end 33 of flexible shaft 31. This rotative connection—as also that of end 32 with bearing bushing 24—may be effected for instance by a tongue-groove connection, a keyed shaft connection, etc. In order to compensate for dimensional tolerances in assembly and also for small deflections of the engine unit support 1 in the direction of axis 14 of crankshaft 5—such deflections being possible to a certain degree during operation of the internal combustion engine—the end 32 of flexible shaft 31 facing the oil pump, is axially displaceable in its rotative connection with bearing bushing 24; the rotative connection at the outer end 33 being fixed in the axial direction. Stop discs 40 and appropriate retaining rings 41 are provided at both ends of flexible shaft 31, in bearing bushing 24 and in rotating sleeve 34. The end 39 of rotating sleeve 34 facing away from the oil pump 22 is secured against axial displacement within bearing bracket 35 by means of a disc 42 and a ring 43.

The relative motion occurring in operation of the internal combustion engine between the crankcase 9 accommodating oil pump 22 and engine unit support 1 which also supports the crankshaft 5 driving the oil pump, can thus be compensated by the flexible shaft 31 without the oil pump drive being impaired thereby.

It is only necessary therein to dimension the free gap between flexible shaft 31 and bearing bushing 24 or rotating sleeve 34 wide enough so that also at the maximum possible deflection of the engine unit support the flexible shaft will not strike against the bearing bushing 24 or the rotating sleeve 34. With such construction it will be possible to accomplish, problem-free and in a simple manner, the ducting of the pressurized oil out of the crankcase, despite the elastic suspension of the engine unit support which is so favorable in respect of noise attenuation of the internal combustion engine, and despite the maintaining of a secure drive of the oil pump by the crankshaft.

Figure 2:
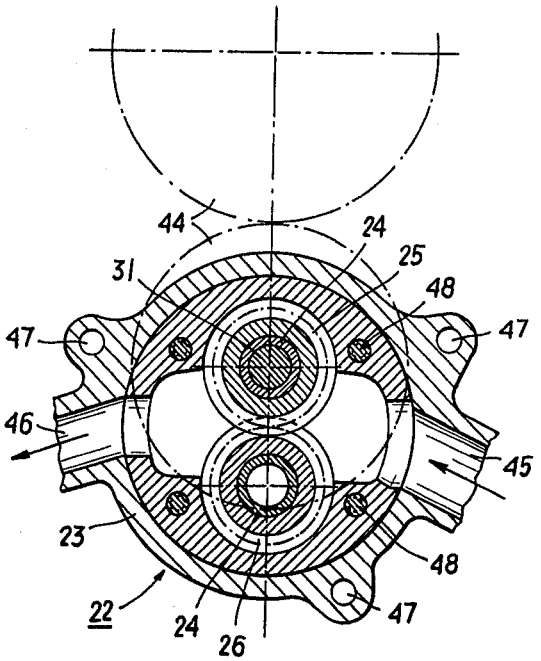

Furthermore, the pitch circles of the gears 37, 38 driving the rotating sleeve 34, can be seen in FIG. 2, as well as inlet 45, and outlet 46 for the oil, and bolt holes 47, 48 for attaching, respectively, pump cover 28 and pump body 23.

It would, of course, be readily practicable within the scope of the invention, to effect the drive of rotating sleeve 34 by crankshaft 5 via a chain or toothed chain, or otherwise, it would also be readily conceivable to extend the flexible shaft and the rotating sleeve to the third bearing bracket, (not shown) to thereby obtain a greater free flexing length for the flexible shaft.

I claim:

1. An internal combustion engine comprising, a crankcase, an engine unit support elastically mounted in said crankcase, said engine unit support including a cylinder head, a cylinder, a piston, a connecting rod, crankshaft main bearings and a crankshaft, an oil pump mounted on a front wall of said crankcase, means for driving said pump by said crankshaft, said pump including a driven pump gear, a hollow cylindrical bearing bushing supporting said driven gear, said driving means comprising a rotatable flexible shaft having one end extending into said bushing which is connected adjacent an outer end thereof to said one end for rotation with said shaft, bearing brackets extending from said crankshaft main bearings, said driving means further comprising a hollow cylindrical sleeve rotatably mounted on at least a first pair of said brackets lying adjacent said pump, said flexible shaft extending into said sleeve, the other end of said shaft being connected to an inner end of said sleeve for rotation therewith, and said shaft being axially displaceable within said bushing and said sleeve at said connected ends thereof.

2. The internal combustion engine according to claim 1, wherein said driving means further comprises a drive gear on an outer end of said sleeve and a corresponding gear on said crankshaft in meshed engagement with said drive gear.

* * * * *